US005238291A

United States Patent [19]

Alionis

[11] Patent Number: 5,238,291

[45] Date of Patent: Aug. 24, 1993

[54] CONVERTIBLE HIGH CHAIR AND SWING APPARATUS

[75] Inventor: Mary K. L. Alionis, Scottsdale, Ariz.

[73] Assignee: Today's Kids, Inc., Booneville, Ark.

[21] Appl. No.: 829,804

[22] Filed: Jan. 31, 1992

[51] Int. Cl.[5] ..... A47C 13/00

[52] U.S. Cl. ..... 297/118; 297/282

[58] Field of Search ..... 297/118, 1, 3, 93, 283, 297/273, 274, 282, 275, 276, 277, 278, 279, 280, 281

[56] References Cited

U.S. PATENT DOCUMENTS

| | | | |
|---|---|---|---|
| 674,910 | 5/1901 | Dutton | 297/281 |
| 825,984 | 7/1906 | Schmersahl | 297/282 |
| 830,487 | 9/1906 | Backe et al. | 297/282 |
| 2,533,019 | 12/1950 | Ketcham | 297/275 |

FOREIGN PATENT DOCUMENTS

| | | | |
|---|---|---|---|
| 320004 | 11/1902 | France | 297/273 |

*Primary Examiner*—Kenneth J. Dorner
*Assistant Examiner*—Cassandra Davis
*Attorney, Agent, or Firm*—Kirkpatrick & Lockhart

[57] ABSTRACT

A chair capable of functioning as a high chair and a swing is disclosed. A frame member consisting of two upstanding support members that are interconnected by horizontal cross members is provided. A chair member having rigid planar side members and a cloth seat member supported therebetween is pivotally attached to the upstanding support members and is adapted to pivot from a first position wherein it functions as a high chair to a second position wherein it functions as a pivotal swing. A tray member is pivotally attached to the side members and is adapted to support food or eating utensils when the chair is functioning as a high chair. The tray member may also be pivoted to a second position to enable the chair to freely swing between the upstanding support members. Spring biased retaining pins are also provided in the upstanding support members to selectively retain the chair in the first position.

8 Claims, 7 Drawing Sheets

CONVERTIBLE HIGH CHAIR AND SWING APPARATUS

BACKGROUND OF THE INVENTION

1. Field of the Invention

The present invention relates to chairs and, more particularly, is directed to chairs that can selectively function as high chairs and swings for supporting a child's doll.

2. Description of the Invention Background

Perhaps some of the fondest memories of most people's childhood experiences are the times spent playing with a favorite doll. Boys and girls alike often pass the hours by having their favorite doll mimic various human activities such as eating and playing with toys. In many instances, the child may prop the doll into his or her high chair to facilitate feeding the doll with imaginary or toy food items. After the child has fed the doll, the doll might be afforded a ride on one of the child's toys such as the child's swing. In the alternative, the child may have a separate toy high chair and toy swing that are made to only accommodate dolls, stuffed animals and the like.

There are many known high chairs or swings that are particularly adapted to accommodate a child or a child's doll. Those swings or high chairs may be provided in a myriad of sizes and shapes. The high chairs or swings that are designed to accommodate children or large dolls may require a relatively a large amount of space, thus precluding some households with limited space from providing their children with both devices. In addition, most parents are interested in getting the most value for their money when buying those types of devices for their children. As such, it is for both of those reasons that would be desirable to have a chair that can function as a high chair and a swing thus eliminating the need to purchase separate and often costly devices to perform those functions.

The present invention is directed toward a chair that can selectively function as a high chair and a swing for supporting a child's doll or toy animal. In the alternative, the present invention may also be constructed to function as a child's high chair that is convertible into a child's swing.

SUMMARY OF THE INVENTION

In accordance with the present invention, there is provided a convertible chair apparatus that is capable of selectively functioning as a high chair and a swing. The chair apparatus may be constructed to support a child's doll or stuffed toy or, if appropriate safety standards are adhered to, it may be constructed to accommodate a child.

The convertible chair apparatus includes a frame member that consists of two upstanding support members that are fastened together in spaced-apart relationship by horizontal cross members. A chair member having a flexible seat member is received between the upstanding support members and is pivotally attached thereto. The chair member is adapted to pivot into a first non-moving position wherein in it may function as a high chair. A serving tray is pivotally attached to the seat member to support eating utensils when the chair is in the first position. Spring-biased retaining pins are attached to the upstanding support members and are adapted to selectively retain the chair member in the first position.

The chair member may also pivot to a second movable position wherein it is free to pivot in a swinging motion between the upstanding support members. When in the second movable position, the serving tray is pivoted to a second position to avoid contacting the horizontal cross members as the chair freely swings between the upstanding support members.

Accordingly, the present invention provides a chair apparatus that can selectively function as a high chair and a swing. In addition to those features, other details, objects, and advantages will become apparent as the following detailed description of the present preferred embodiment thereof proceeds.

BRIEF DESCRIPTION OF THE DRAWINGS

In the accompanying drawings, I have shown a present preferred embodiment of the invention wherein like reference numerals are employed to designate like parts and wherein.

DETAILED DESCRIPTION OF THE PREFERRED EMBODIMENTS

Figure 1:
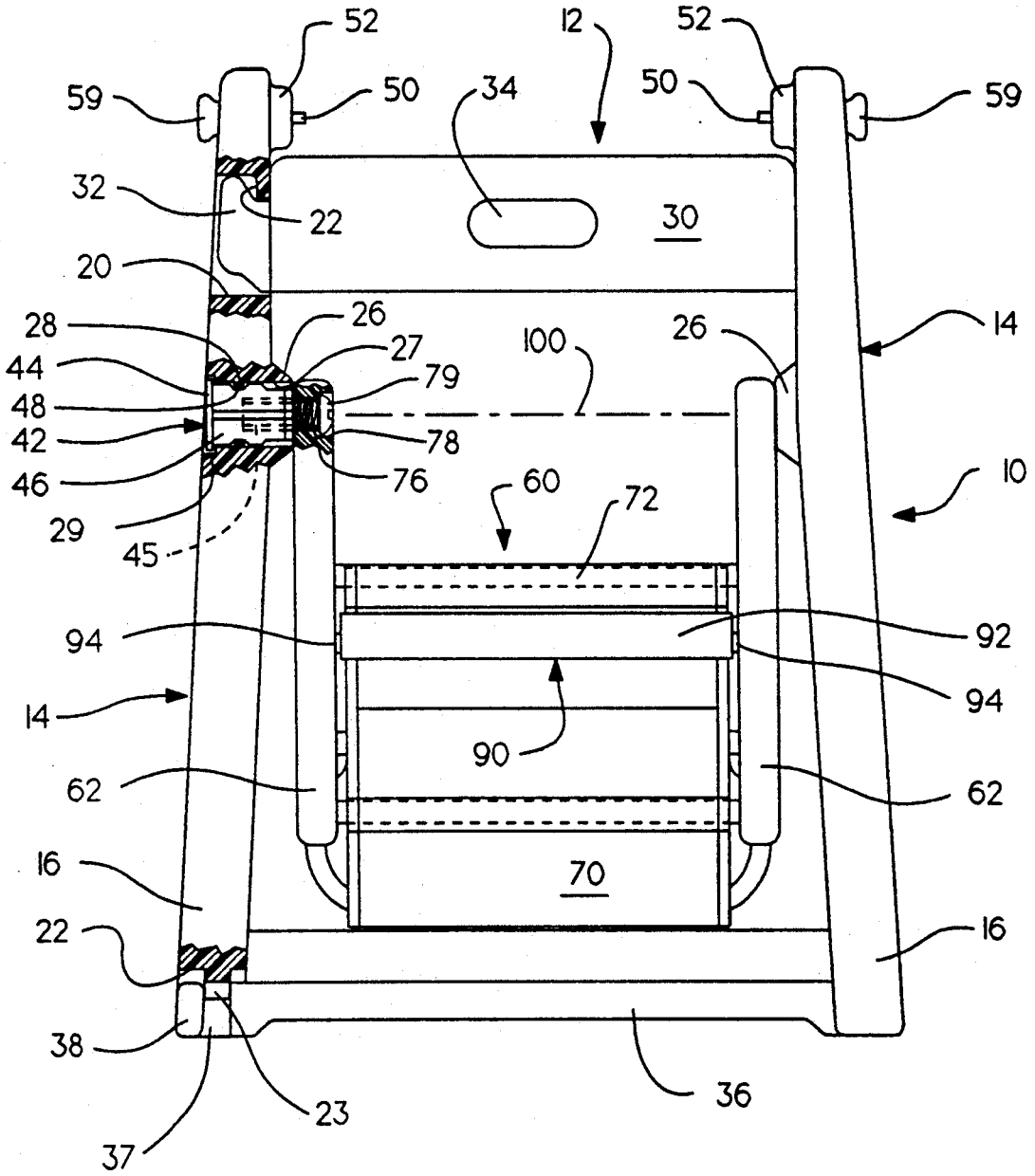
FIG. 1 is a front elevational view of the convertible chair of the present invention with the chair member functioning a swing.

Referring now to the drawings for the purposes of illustrating the present preferred embodiment of the invention only and not for purposes of limiting the same, the Figures show a convertible high chair and swing apparatus generally designated as 10. While the convertible high chair and swing apparatus 10, as described below, is preferably constructed to support a child's doll or stuffed toy, those of ordinary skill in the art will appreciate that the present convertible high chair and swing 10, in accordance with applicable safety standards, may be constructed to accommodate a child.

More particularly, and with reference to FIG. 1, the apparatus 10 consists of a frame member generally designated as 12 and a chair member generally designated as 60. The frame member 12 consists of two upstanding lateral support members 14, upper and lower horizontal cross members 30 and 36, respectively, and a rear cross member 40. In the preferred embodiment, the above-described components of frame 12 are fabricated primarily from molded plastic and are generally constructed to snap together. However, it will be appreciated that the frame member 12 may be fabricated from any other known material from which high chairs or swings are fabricated, such as metal or wood. Further, the frame member 12 may be molded as one piece or, in the alternative, may consist of a number of component parts which are fastened together by other known fastening means such as, for example, bolts or screws.

Figure 3:
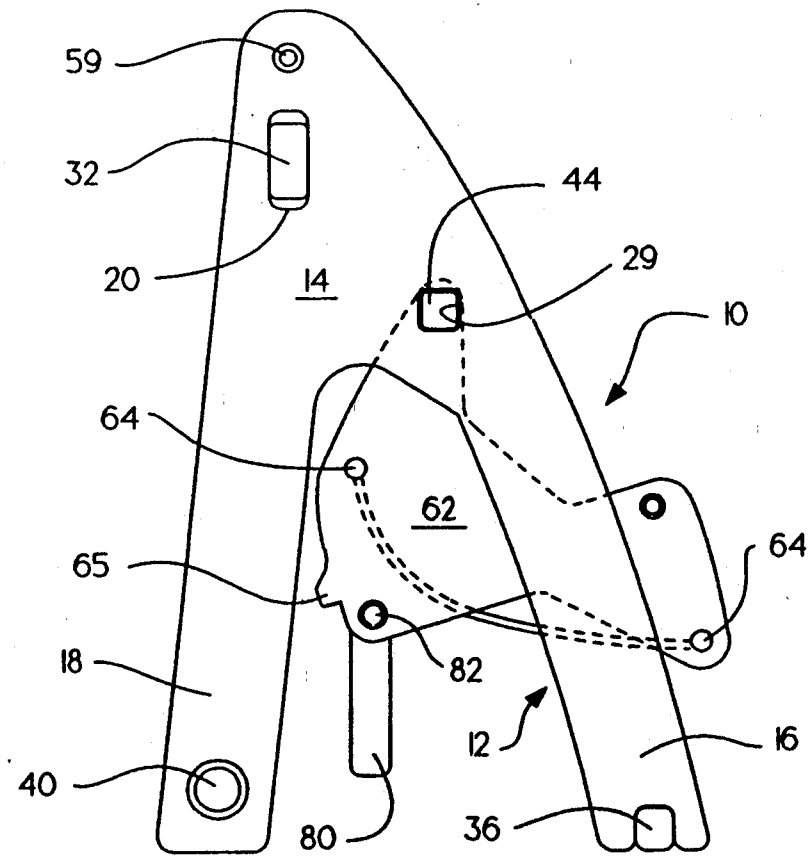
FIG. 3 is a left side elevational view of the convertible chair of the present invention with the chair member functioning as a swing.
Figure 2:
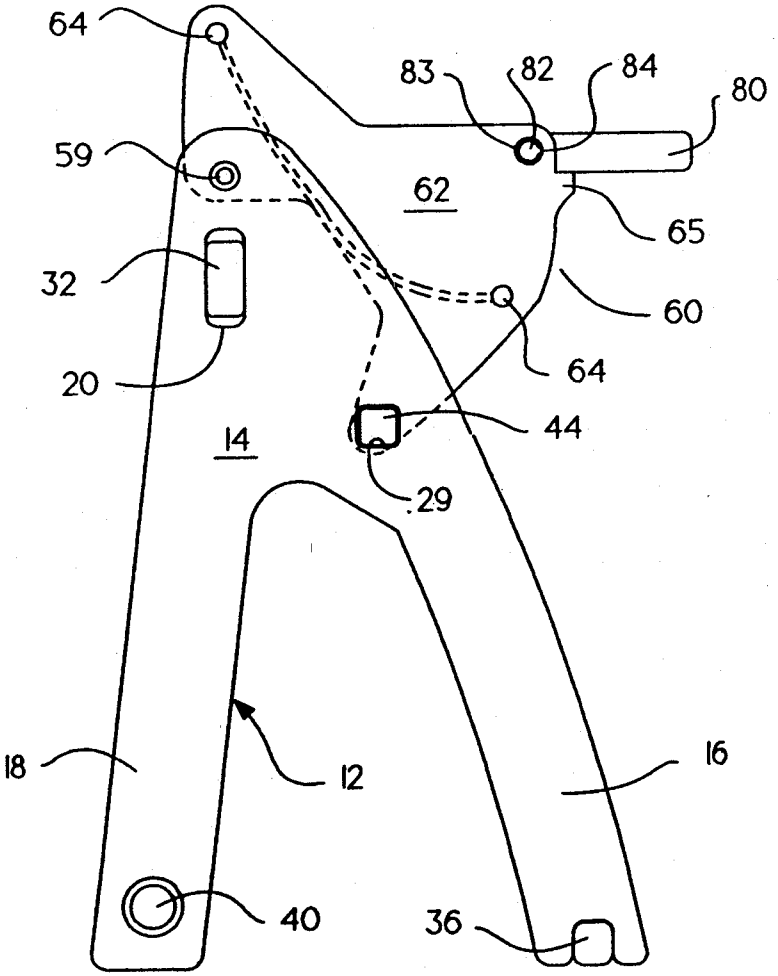
FIG. 2 is a left side elevational view of the convertible chair of the present invention with the chair member functioning as a high chair.

As shown in FIGS. 1-3, the frame member 12 includes two upstanding lateral support members 14 that are the mirror image of one another and each preferably comprise slightly curved members with front and rear leg members 16 and 18, respectively. The lateral support members 14 are fastened together in spaced apart relationship by an upper horizontal cross member 30, a lower front horizontal cross member 36 and a rear cross member 40.

As most particularly shown in FIG. 1, a hook-shaped member 32 is formed into each end of the upper cross member 30 for attaching the upper cross member 30 to the upstanding lateral support members 14. More specifically, a slot 20 is provided in each lateral support member 14 that is adapted to receive a corresponding hook-shaped member 32 therein. Each slot 20 has a webbed portion 22 formed therein that is adapted to engage a corresponding hook-shaped portion 32 and thus affix the upper cross member 30 to the corresponding upstanding lateral support member 14. It will be appreciated, however, that the horizontal cross member 30 may be attached to the upstanding lateral support members 14 by a myriad of other known fastening means. Also, the horizontal cross member 30 preferably has a centrally located slot 34 therein (See FIG. 1) that serves as a convenient gripping handle for transporting the convertible chair apparatus 10.

Figure 4:
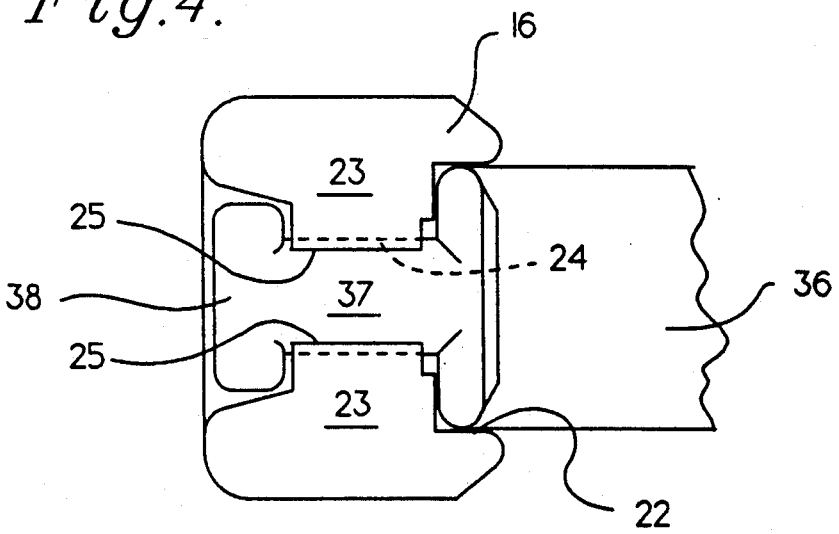
FIG. 4 is a bottom view of the front leg member and cross member of the convertible chair of the present invention.

The lower cross member 36 extends between the front legs 16 of the upstanding support members 14 and is preferably attached thereto in the manner depicted in FIGS. 1 and 4. More specifically, each front leg 16 has a slot 22 therein adapted to receive a corresponding end of the lower cross member 36 therein. A shoulder member 23 is provided in each slot 22 and serves to define a narrow cavity 24 that is adapted to receive a corresponding narrow portion 37 that is provided on each end of the cross member 36. Formed into the shoulder 23 are two engagement tabs 25 (See FIG. 4) that are adapted to be snapped into engagement with the corresponding narrow portion 37 of the lower cross member 36. An enlarged end portion 38 is provided on each end of the cross member 36 to prevent any substantial lateral displacement of the cross member 36 when the narrow portions 37 are received within the corresponding shoulder members 23. It will be understood, however, that the lower cross member 36 may be provided in a number of other shapes and configurations and may be fastened to the front legs 16 of the upstanding support members 14 by any fastening means that is compatible with the material comprising the cross member 36 and the lateral support members 14.

Figure 5:
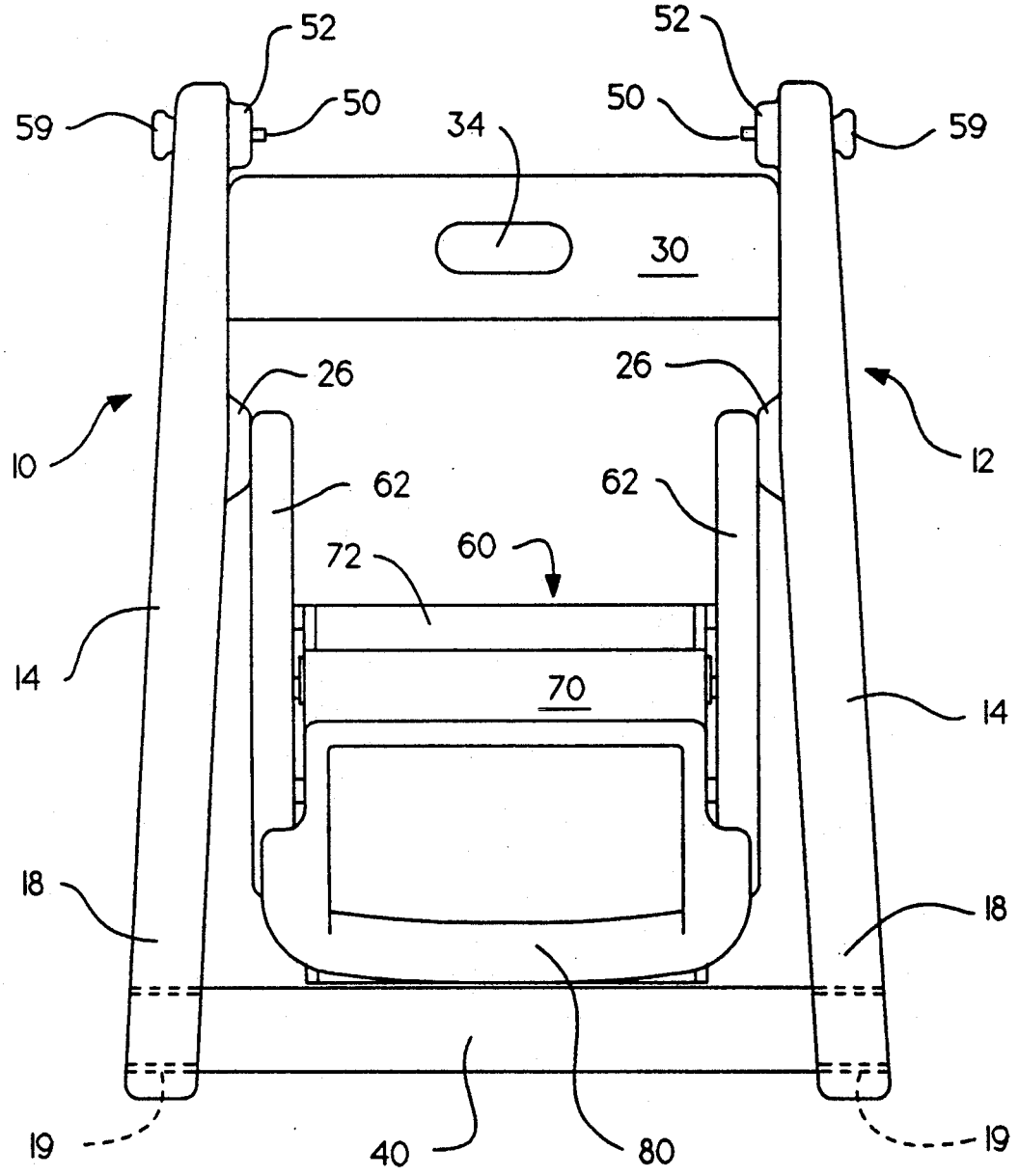
FIG. 5 is a rear elevational view of the chair of the present invention with the chair member functioning as a swing.

Referring now to FIGS. 2, 3 and 5, the frame 12 also includes a rod-shaped rear support member 40 that extends between the rear legs 18 of the upstanding support members 14. The rear support member 40 preferably has a series of right-handed threads provided on its one end and a series of left-handed threads provided on its other end that are adapted to be threadedly received corresponding internally threaded bores 19 located in each of the rear legs 18. Although the rear support member is preferably a hollow plastic rod with the above-described threads molded into its ends, it will be appreciated that the rear support member 40 may be fabricated from a number of different materials and be fastened to the upstanding support members 14 by any appropriate fastening means.

The chair member 60 consists of two planar side members 62 adapted to support a flexible seat member 70 therebetween. The planar side members 62 are preferably shaped as shown in FIGS. 2 and 3, however, the side members 62 may be provided in a number of shapes that will permit the chair member 60 to assume the positions depicted in those Figures.

In the preferred embodiment, the flexible seat member 70 consists of a rectangular piece of fabric such as cloth that has sleeves 72 sewn into its two shortest ends. The sleeves 72 are created by folding a small portion of the cloth back onto itself to create a sleeve and then stitching the two pieces of fabric together. It will be appreciated that the seat member 70 may also be fabricated from high strength nylon cloth with reinforced stitching to enable the seat member 70 to support the weight of a child.

Figure 6:
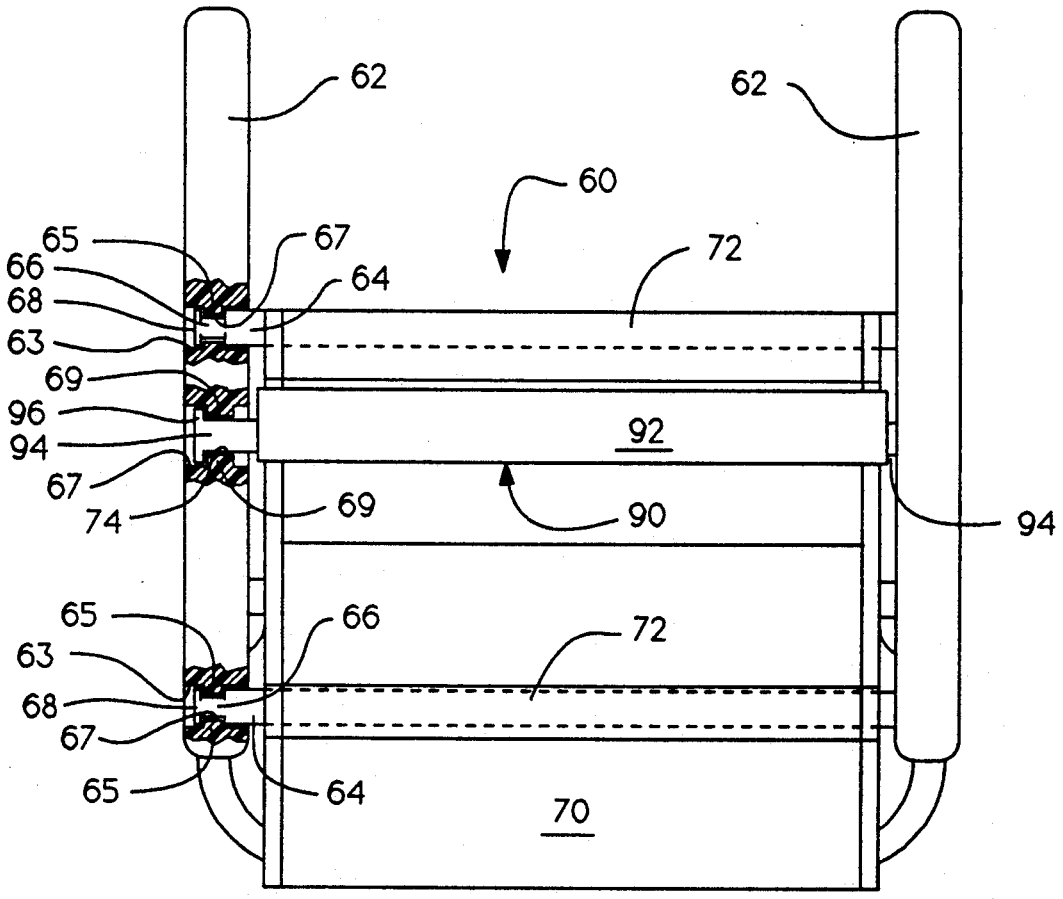
FIG. 6 is front view of the chair member of the present invention.

As can be seen in FIG. 6, the flexible seat member 70 is supported between the side members 62 by two cross members 64 that extend through the sleeves 72 to be received in corresponding bores 63 provided in each side member 62. Each of the cross members 64 preferably comprises a barshaped member having a rectangular cross section that has a smaller neck portion 66 protruding from each end. The cross members 64 also preferably have a rectangular shaped flange member 68 attached to the end of each neck portion 66 that is adapted to be received in a corresponding bore 63 located in the side members 62. As can be most particularly seen in FIG. 6, internal shoulder members 65 are provided in each bore 63 that define a rectangular opening 67 sized to permit the rectangular shaped flange member 68 to pass therethrough when turned in one position and to retain the neck portion 66 therein when the cross member 64 is rotated ninety degrees from that position. It will be understood that by rotating the cross member 64 ninety degrees after it has been inserted through the opening 67, the flange member 68 is caused to assume a position wherein it cannot pass through the opening 67 thereby affixing the cross member 64 to the corresponding side member 62. It will be appreciated by those of ordinary skill in the art, however, that the cross members 64 may be fastened to the side members 62 by other known fastening means.

Figure 7:
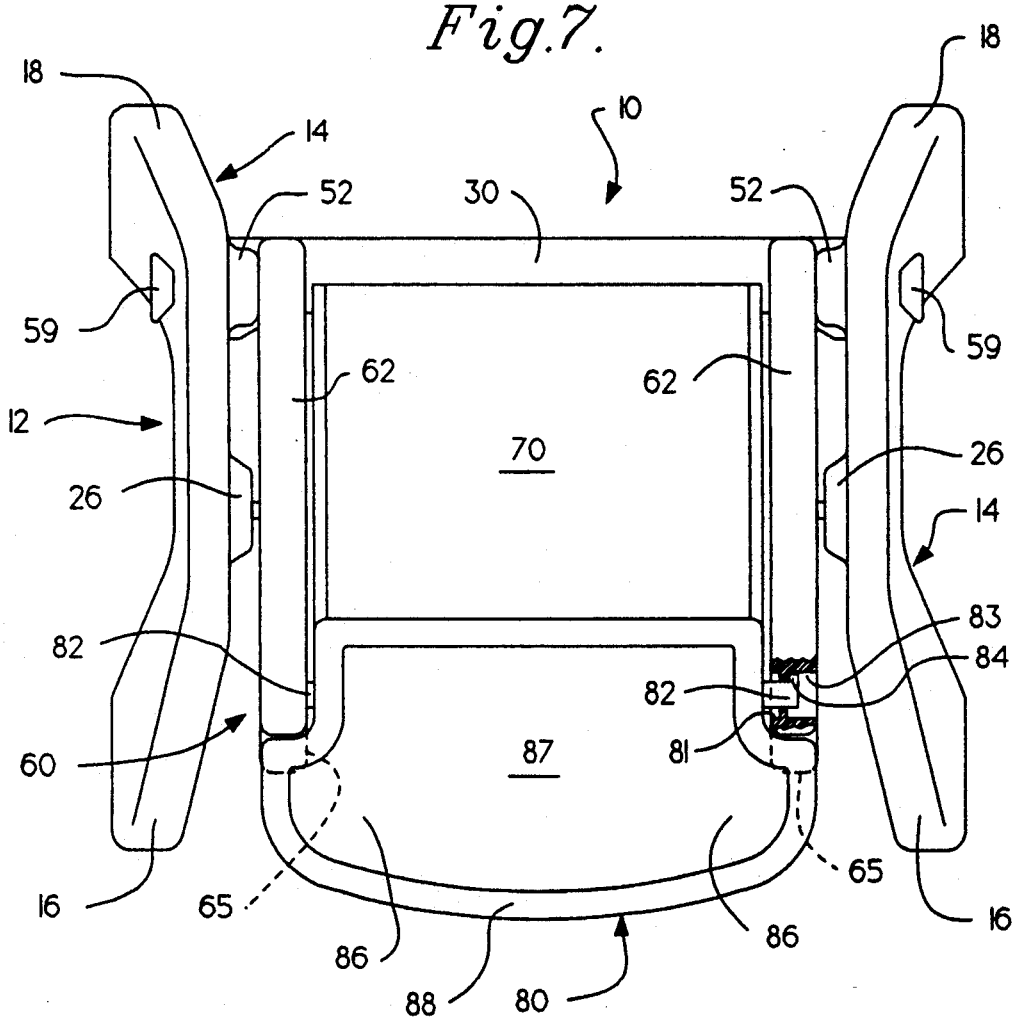
FIG. 7 is a top view of the convertible chair of the present invention with the chair member functioning as a high chair.

As most particularly shown in FIG. 7, a serving tray 80 is pivotally attached to the side members 62. In the preferred embodiment, the tray 80 has two outwardly protruding rod members 82 attached thereto that are adapted to be received in corresponding bores 81 located in the side members 62. Corresponding counterbores 83 coaxial with the bores 81 are provided in each side member 62 to rotatably receive therein a retaining lug 84 that is formed into the end of each rod member 82. A small slot (not shown) extends between the bore 81 and the corresponding counterbore 83 to enable the retaining lug 84 to be inserted into the counterbore 83 as illustrated in FIG. 7. Accordingly, the retaining lugs 84 are free to rotate within the bottom of counterbores 83 in response to the rotation of the serving tray 80 and thus serve to rotatably affix the serving tray 80 to the side members 62. It will be appreciated, however, that the serving tray 80 may be rotatably fastened to the side members 62 by any compatible fastening means. Further, the serving tray 80 is preferably at least rotatable between the two positions illustrated in FIGS. 2 and 3. In particular, when the apparatus 10 is functioning as a high chair, as shown in FIG. 2, the serving tray 80 is supported in a general horizontal position by two outwardly extending tab members 65 that are formed into the front portion of the side members 62. As can also be seen in FIG. 7, the serving tray 80 is shaped such that it has two laterally extending flared portions 86 that extend over the tab members 65 to support the serving tray 80 in a general horizontal position. In addition, a small ridge member 88 is preferably provided around the perimeter of the upper surface 87 of the serving tray 80 to aid in the retention of, for example, eating utensils.

When the apparatus 10 is functioning as a swing, the serving tray 80 is rotated into a second position as illustrated in FIGS. 3 and 5. It will be appreciated that when the serving tray 80 has been rotated into that second position, it will not interfere with the swinging action of the chair member 60. Also, to provide support for the seat's occupant when the chair member 60 is functioning as a swing, a retaining bar 90 is provided as shown in FIGS. 1 and 6. The retaining bar 90 has an elongated central portion 92 that has a rectangular cross section and two smaller neck portions 94 that protrude from each end of the central portion 92. Rectangular-shaped flange members 96 are attached to the ends of the neck portions 94 and are adapted to be received in corresponding bores 67 located in the side members 62. As can be most particularly seen in FIG. 6, internal shoulder members 69 that cooperate together to define a narrow rectangular shaped opening 74 therebetween are provided in each bore 67. The rectangular opening 74 is sized to permit a corresponding rectangular shaped flange member 96 to pass therethrough when the retaining bar 90 is turned in one position and to prevent the passage of the flange member 96 therethrough when the retaining bar 90 is rotated ninety degrees from that position. It will be understood that by rotating the retaining bar 90 ninety degrees after it has been inserted through the opening 74, the flange member 96 is caused to assume a position wherein it cannot pass through the opening 74 thereby affixing the retaining bar 90 to the corresponding side member 62. It will be appreciated by those of ordinary skill in the art, however, that the retaining bar 90 may be fastened to the side members 62 by other known fastening means.

As can be seen in FIG. 1, the chair member 60 is pivotally received between two boss members 26 that are preferably formed on each of the inside edges of the upstanding lateral support members 14. Each boss member 26 has a bore 27 that extends therethrough that is adapted to receive a corresponding fastening member 42 therein. The fastening members 42 are preferably constructed of molded plastic and have a square shaped flanged member 44 formed on the one end thereof and an internally threaded socket 45 formed in the other end thereof. Laterally extending spline members 46 having notches 48 therein are also preferably formed along the length of the fastening member 42. The fastening member 42 is retained within the bore 27 in the manner shown in FIG. 1. The square shaped flange member 44 is received in a corresponding square shaped socket 29 provided in the upstanding support member 14 to prevent the internally threaded member from rotating in the bore 27. The fastening member is retained with the bore 27 by virtue of the notches 48 engaging an annular shoulder 28 provided in bore 27. Accordingly, the chair member 60 is pivotally attached to the upstanding support members 14 by screws 79 that extend through a corresponding bore 76 and counterbore 78 provided in the side members 62 to be threadedly received in a corresponding internally threaded socket 45. It will be appreciated that bores 76 and counterbores 78 are slightly larger than the screws 79 so that the side members 62 may pivot freely about the axis 100 extending between the screws 79. Those of ordinary skill in the art will recognize, however, that the chair member may be pivotally attached to the upstanding support members 14 by any suitable fastening means.

Figure 9:
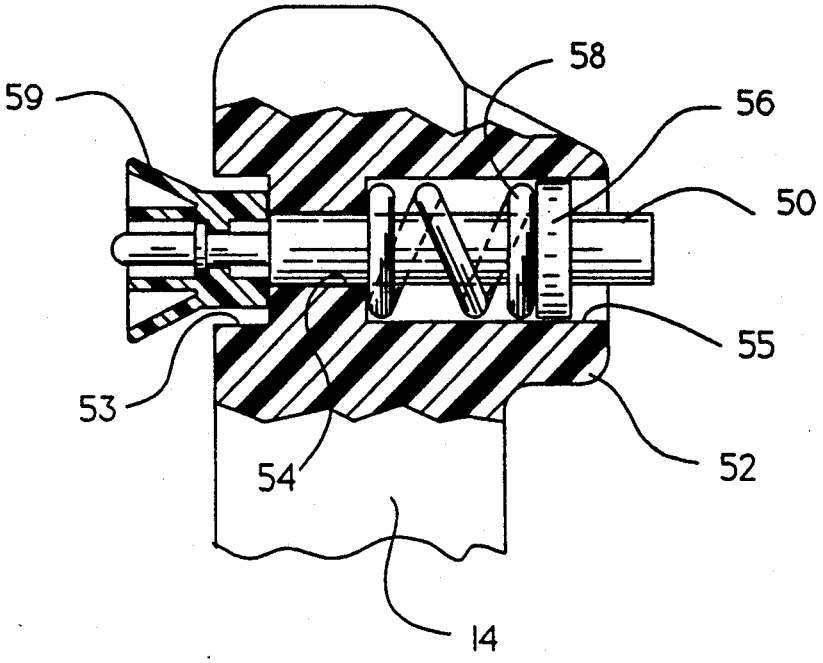
FIG. 9 is a cross sectional view of the retaining member of the present invention.
Figure 8:
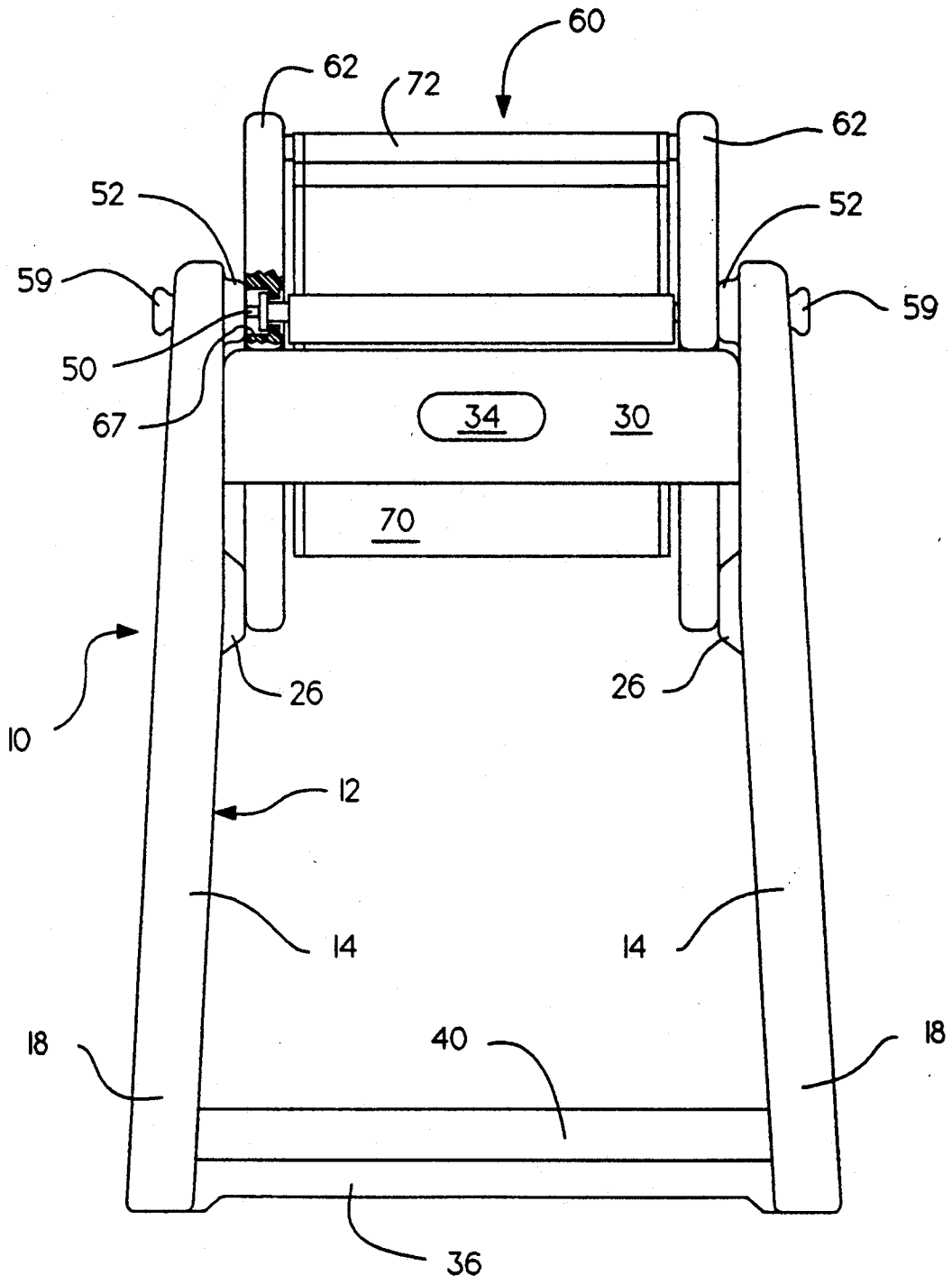
FIG. 8 is a rear elevational view of the convertible chair of the present invention with the chair member functioning chair.

In the preferred embodiment, spring biased retaining pins 50 are provided in the upper portion of each upstanding support member 14 to retain the chair member in an upright position thus permitting the apparatus 10 to function as a high chair. As shown in FIGS. 8 and 9, boss members 52 are preferably formed on the upper portions of the upstanding support members 14 and are arranged to receive the side members 62 therebetween when the chair member 60 is functioning as a high chair. The retaining pin 50 is preferably slidably received in a corresponding first counterbore 53, a second coaxial bore 54 and a third coaxial counterbore 55 that extends through the upstanding support member 14 and the boss member 52 as shown in FIG. 9. The retaining pin 50 preferably has a flange member 56 attached thereto that cooperates with a coil spring 58 to bias the end of the retaining pin 50 into the corresponding bores 67 located in the side members 62 as shown in FIG. 8. A handle member 59 (See FIG. 9) is preferably attached to the other end of the retaining pin 50 to enable the retaining pin 50 to be selectively retracted into the counterbore 55 when the chair member 60 is pivoted into the high chair position illustrated in FIGS. 2, 7 and 8. Once the chair member 60 is moved to that position, the handle members 59 are released to enable the retaining pin 50 to be biased into the corresponding bores 67 located in the side members 62 and thus retain the seat member 60 in an upright non-moving position. Those of ordinary skill in the art will further appreciate that other known retaining methods and devices such as, for example, hooks or magnetic catches may also be used to selectively retain the chair member 60 in that first non-moving high chair position.

When constructed as described above, the chair member 60 may be pivoted into a first non-moving position wherein it functions as a high chair. In the alternative, the chair member 60 may be pivoted into a second position as shown in FIGS. 1, 3 and 5 wherein it functions as a swing pivoting about the axis 100. The chair member 60 may be easily moved from the first non-moving position to the second swinging position by retracting the spring biased retaining pins 50 into their corresponding counterbores 55 and out of engagement with the corresponding bores 67 to enable the chair member 60 to freely pivot into the second swinging position. Also, when the chair member 60 is functioning as a swing, the serving tray 80 is pivoted to the position shown in FIGS. 3 and 5 to avoid contacting the rear support member 40 as the chair member 60 pivots about the screws 79.

Accordingly, the present invention is capable of functioning both as a high chair and a swing and thus eliminates the need for two separate and often costly devices to perform those functions. It will be understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. An occupant supporting chair, comprising:

a frame member;

a seat member having a first occupant supporting side and a second occupant supporting side; and means for supporting said seat member on said frame member in a first position wherein the occupant is supported on said first occupant supporting side and wherein said seat member is fixed relative to said frame member and said supporting means further including means for pivotally supporting said seat member in a second position inverted with respect to said first position wherein the occupant is supported on said second occupant supporting side and wherein said seat member is adapted to pivotally swing relative to said frame member.

2. The chair recited in claim 1 wherein said frame member comprises:

a pair of upstanding support members adapted to receive said seat member therebetween wherein and, said pivot support means attaches said seat member to said upstanding support members so that said seat member is adapted move between said first position and said second position.

3. The chair recited in claim 2, wherein said pivot means is attached to said upstanding support members so that said seat member is adapted to pivot between said first position and said second position and swing about said pivot means when in said second position.

4. The chair recited in claim 3 in which said support means further includes retaining means for selectively retaining said seat member in said first position.

5. The chair recited in claim 4 wherein said seat member comprises:

a pair of side members pivotally attached to said upstanding support members;

a plurality of cross members attached to said side members and extending therebetween;

a flexible member attached to said plurality of cross members and extending therebetween, said flexible member having a first side and a second side wherein said first side is adapted to support an occupant when said seat member is in said first position and said second side is adapted to support an occupant when said seat member is in said second position.

6. The chair recited in claim 5 wherein said retaining means comprises:

an aperture in each of said side members; and a spring biased engagement member attached to each said upstanding support member and being adapted to selectively engage said apertures in said side members to retain said seat member in said first position.

7. The chair recited in claim 6 further including a tray member attached to said seat member.

8. The chair recited in claim 7 wherein said tray member is pivotally attached to said seat member for movement between one position in which said tray member is horizontally disposed when said seat member is in said first position and another position in which said tray member is substantially vertically disposed when said seat member is in said second position.

* * * * *

UNITED STATES PATENT AND TRADEMARK OFFICE

CERTIFICATE OF CORRECTION

PATENT NO. : 5,238,291
DATED : August 24, 1993
INVENTOR(S) : Mary K. Litwicki Alionis It is certified that error appears in the above-indentified patent and that said Letters Patent is hereby corrected as shown below:

Col. 2, line 44, after "functioning", insert --as a high--.

Col. 7, line 28, after "therebetween", insert --and--.

Col. 7, line 29, delete "and,".

Col. 7, line 33, after "adapted", insert --to--.

Signed and Sealed this

Twenty-ninth Day of March, 1994

Bruce Lehman

*Attest:*

BRUCE LEHMAN

*Attesting Officer*

*Commissioner of Patents and Trademarks*